United States Patent [19]

Stoll

[11] Patent Number: 4,565,259

[45] Date of Patent: Jan. 21, 1986

[54] CONNECTION BLOCK

[76] Inventor: Kurt Stoll, Lenzhalde 72, D-7300 Esslingen, Fed. Rep. of Germany

[21] Appl. No.: 624,605

[22] Filed: Jun. 26, 1984

[30] Foreign Application Priority Data

Jul. 26, 1983 [DE] Fed. Rep. of Germany ..... 3326802

[51] Int. Cl.[4] ..... F01N 1/10

[52] U.S. Cl. ..... 181/230; 181/243; 181/256; 181/268; 181/269; 181/239

[58] Field of Search ..... 181/224, 230, 225, 243, 181/256, 258, 268, 275, 269, 239

[56] References Cited

U.S. PATENT DOCUMENTS 3,059,564 10/1962 Curran et al. ..... 181/224 X 3,882,961 5/1975 Cannan et al. ..... 181/258

4,313,522 2/1982 Gorchev et al. ..... 181/268 X 4,474,260 10/1984 Valentine ..... 181/243 X

*Primary Examiner*—Benjamin R. Fuller

*Attorney, Agent, or Firm*—McGlew and Tuttle

[57] ABSTRACT

A connection block or adapter for joining up pneumatic components is made with an exhaust muffler to let off air from components into the outside atmosphere. The muffler is composed of a chamber inside the connection block and has a porous wall. The wall may be made in one piece with the connection block or bonded to it as a separate part. Preferred materials are load bearing foam resin for the connection block and metal frit for the wall of the muffler.

8 Claims, 4 Drawing Figures

CONNECTION BLOCK

BACKGROUND OF THE INVENTION

The present invention relates to connection blocks for pneumatic components.

THE PRIOR ART

Such connection blocks have for example been used in the form of component-mounting or adapter units, by which components run on compressed air may be joined up with the compressed air source and the means for taking up exhaust or expanded air from the component. In this case multi-connection plugs are currently used on a wide scale that make it possible for a number of air ducts to be put in circuit with one single plugging-in motion. As compared with the joining up of separate compressed air lines, as for example flexible hoses, multi-connection plugs are distinguished by needing less space. Moreover there is less danger of a pneumatic component being wrongly connected up with others.

The connection blocks to which the present invention relates are the junctions or interconnections, as necessary for the simultaneous joining up of compressed air lines of pneumatic components. On their surface the connection blocks have contact sites placed in a formation in keeping with arrangement of such sites on the components to be connected. The contact sites corresponding to the circuit to be built up are joined up by way of ducts within the connection block and running therethrough to the surface thereof. The ducts may for example be in the form of holes drilled into the solid material of the block. However it is furthermore possible for the ducts to be in the form of channels in the surface of the block, which are open when the block is not mounted and only function as ducts when the block is fixed in place and its end face is pressed air-tightly against the componenent that is to be supplied with air, and covers over the sides of the channels. In prior art blocks at least one of these ducts has been designed as a exhaust duct for producing the flow path to a duct or other means taking up spent air from the component. This exhaust duct may for example branch into a manifold duct, that takes up the low-pressure spent air from different components run on compressed air and opens into the free atmosphere at some point removed from the connection block. This system does however suffer from the shortcoming that the low-pressure air is opposed by a certain amount of resistance hindering prompt clearance of the air. Furthermore it is then necessary to have a large cross section pipe for the spent air manifold duct that takes up much material and space, its function being to lead away the large amounts of air at a low pressure.

Furthermore it is normal practice in certain applications for the spent air coming from the components driven by compressed air to be let off directly into the outside air. That is to say, in this case the spent air is not collected in a manifold or branch duct and furthermore it does not flow through a connection block. The direct discharge of the spent air into the surroundings is however responsible for the drawback of producing an unpleasant hissing noise in the case of components powered at normal operating pressures. In a room that has to be occupied by operating staff at all times the effect on the nerves and the physical stress caused is then generally not to be tolerated. Although exhaust air mufflers have been developed for direct connection with air-power components, there are many cases in which there is not sufficient room for fitting them and in many cases they tend to be inefficient, because the low pressure air does not have enough room in which to expand.

SHORT OUTLINE OF THE INVENTION

One purpose of the present invention is to take care of the shortcomings of the prior art as noted.

A further purpose is to design an air exhaust means for pneumatic components, that while simple in structure, makes possible a quiet, rapid let-off of large amounts of spent air.

A still further purpose is to create such an exhaust means which is of universal application.

For effecting these and other purposes or objects of the invention, a connection block has a chamber within it, that is joined up with the outside air by way of a porous outer wall of the block and has a exhaust duct opening into it.

It will be seen from this that the invention makes it possible for spent air to be let off from components by way of a connection block, which has an integral muffler. The muffler unit is made up of a chamber, whose volume is preferably large in comparison with that of the ducts in the connection block and is delimited by a porous wall with a large area. The spent air makes its way into this chamber from the pneumatic component by way of a exhaust duct. If necessary the air may expand so that there is a concomitant pressure drop, and the air is let off through the porous wall of the connection block with, at the most, only a very small amount of noise; that is to say the escape of the air into the outside atmosphere from the connection block takes place without being a nuisance to operating staff in the immediate vicinity of the pneumatic component. Because this is so, there is only a negligible amount of resistance to flow in the let-off duct. The invention makes it feasible in many cases to do without large-volume, high-price manifold ducts for the spent air. Causing the spent air to flow through the connection block is not responsible for any design problems, and in many cases the dead space, that so far has not been put to any good use, may have the chamber taking up and letting off the spent air placed therein. Moreover it is very much simpler to fit a connection block with a spent air muffler than to fit one to complex air power components designed to take up a small amount of space. A further point is that a connection block is beneficial inasfar as the spent air from a number of air-power components may be collected. In place of having a number of mufflers each joined up separately with a component, the spent air from the components is led off through a single muffler fitted on the connection block so that the system becomes much more simple.

It is possible for the chamber to take the form of a hollow in the connection block near the edge thereof so that the outer wall of the block is in the same plane as the surface of the connection block. This has the useful effect that the connection block has a smooth or regular outer surface and there is the useful effect that there are no projecting edges or corners that might cause injury or damage. Furthermore the block has a pleasing and tasteful appearance.

The outer wall of the chamber may be made in one piece with the connection block so that the block is very simple to manufacture.

The chamber may take the form of a pocket made in the surface of the connection block and covered with a porous plate, or the chamber may be in the form of the space inside a separate housing that is sealingly fixed to the connection block. In this case the housing may be open on one side and is so arranged that its opening is placed around the outlet port of the exhaust duct on the outside of the connection block. With such a design of the invention, the porous wall material of the chamber can be selected independently of the structure of the connection block so that the design offers a wide choice of different possibilities with respect to mechanical strength, working life and the like.

At least a part of the connection block may be made of load-bearing foam material so that the block is specially cheap and simple to produce. Furthermore it is then possible for the spent air muffler in keeping with the invention to be manufactured integrally with the connection block so that less complex tooling is necessary and production time is shorter. Connection blocks made of load-bearing foam material are however furthermore well suited for use with the housing of a separately produced spent air muffler. The housing may for example be foam-molded in situ, this again keeping down the complexity of manufacture. It is however furthermore possible for the housing to be adhesively bonded to the connection block, in which respect the preferred method is to partly or completely pare off the unfoamed outer skin where the load-bearing foam structure is to be bonded at an adhesive contact zone. This makes possible a very high level of adhesion of the bonding material, because the specific surface area is very large at the bonding site; the outcome is that the bond between the connection block and the muffler is very long lasting and firm.

Further useful effects of the invention will be learned from the account now to be given of three working examples thereof to be seen in the figures herein.

DESCRIPTION OF THE PREFERRED EMBODIMENTS

Figure 1:
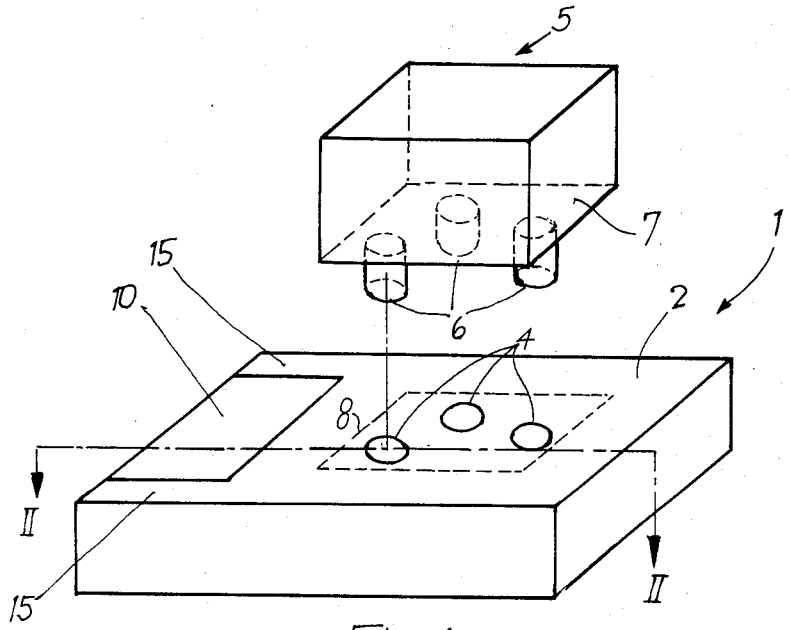
FIG. 1 is a perspective view of a first design of the connection block in keeping with the invention with the spent air muffler.

Turning firstly to FIG. 1 of the drawings the reader will be able to see a connection block generally referenced 1, that is designed for the connection of pneumatic components. Within the meaning of the term as used in the instant specification and claims, such pneumatic components may be active and passive components working with fluid under pressure, including pumps for such fluids, components running on such fluid and systems for taking up spent or exhaust driving fluid. A preferred use for the connection block 1 may be the production of connections between pressure driven logical circuits and sensors and loads used therewith. In the example in the figure the connection block has the form of a parallelepiped, although other forms are possible as for example one matching the outline of the components to be connected together. The connection block 1 has one or more normally even contact faces 2, on which a number of pneumatic components may be fixed and which are to be joined together. A number of inner ducts 3 of the connection block are ported at the contact faces 2 for producing the desired connections between the pneumatic components. The ducts 3 may be in the form of drilled holes or of passages in the solid material of the connection block; it is however possible for the ducts to be at least in part in the form of channels cut from or formed in the surface of the material and which are covered over by the end face of the component to be mounted so as to form a complete duct shut in on all sides. Such channels are not to be seen in FIG. 1 in which only the ports 4 of ducts 3 otherwise running within the material of the connection block 1 are to be seen.

The ports 4 of the ducts are used as contact sites for a pneumatic component 5, that is to be seen lifted clear of the connection block 1. The component 5 has a number of compressed air terminals or connections 6. These connections are placed in keeping with a desired connection pattern on a flat surface 7 of the component 5. This surface 7 is placed against the contact face 2 of the connection block 1 when mounting has taken place. The ports 4 at the ends of the ducts 3 are placed exactly in keeping with this connection pattern. If the component 5 is lowered down onto a position 8 marked in broken lines on the connection block a compressed-air tight duct connection is produced between its compressed air connections 6 and the ducts 3. On generally the same lines a second, and if desired, further components as well are fixed in place on the connection block 1 with the ducts 3 producing the desired connection between these components.

For mechanically attaching the components 5 on the connection block 1 there is a plug connection element marked in FIG. 1. The compressed air connections 6 of the component 5 are for this purpose designed in the form of plug-like pipe unions or male connector halves that fit sealingly into the ports 4 of the ducts 3. The design might however be the opposite to this with the male connector halves running out from the connection block 1 and with matching sockets therefor in the components 5. Lastly it would furthermore be possible for there to be a gasket between the connection block 1 and the component with male connector halves on both sides of the gasket fitting into sockets in the connection block 1 and the component 5, although this is not figured.

The range of application of a connection block 1 functioning on the general principle described is very wide. It may for example be used as a manifold plate for a number of pneumatic valves, that are supplied from a common compressed air source. Typical compressed air connections of such valves are in the form of a pressure line running to the compressed air source, power air lines running to one or more controlled air-powered units, servo lines for the transmission of control signals in the case of pneumatically controlled valves, and an exhaust line running to an exhaust connection. The connection of the different valves and their loads is taken care of inside the distribution plate. The connection block 1 in keeping with the invention may however also be used as a base plate for a fluidics circuit made of compressed-air-operated logical units or modules and containing the circuit logics. In the case of a further possible application the connection block 1 functions as an adapter plate between a standardized pressure fluid connection, for example in a distribution box, and an active or passive pressure-operated component that is to be joined up therewith. Such an adapter plate has pressure connections on the one side thereof in standardized positions and on the same or another contact face it has connection ports with a geometry customized to suit the form of the component so that the ports are linked in the desired way by way of internal connections.

In keeping with the invention at least one of the internal ducts within the body of the connection block 1 functions as an exhaust duct 9. This duct takes up low-pressure or spent air coming from the components 5 connected with the connection block and conducts it by way of a muffler 10 into the outside atmosphere. The muffler is integrated in the connection block 1. It is made up of a chamber 11, that is positioned within one section of the connection block 1. The chamber 11 is in communication with the exhaust duct 9. It has a porous or foraminous outer wall 12, that acts as a choked flow path into the outside air. The chamber 11 preferably has a very much larger volume than the exhaust duct 9. For this reason, when the component 5 is exhausting air, such spent air may first expand in the inside of chamber 11 so that there is drop in pressure. The air then makes its way slowly out through the porous wall 12 more or less silently. It would not be possible to have a similar expansion chamber with a porous wall thereto in the component 5 itself because generally there would not be enough room therefor; on the other hand having a muffled exhaust facility in a connection block 1 makes possible exhaust in the direct vicinity of the component 5 so that there are short flow paths and exhaust takes place at a high speed. There is also the further possibility that more than one component may exhaust through one and the same muffler 10, this making the best possible use of the structure and the space available.

Figure 2:
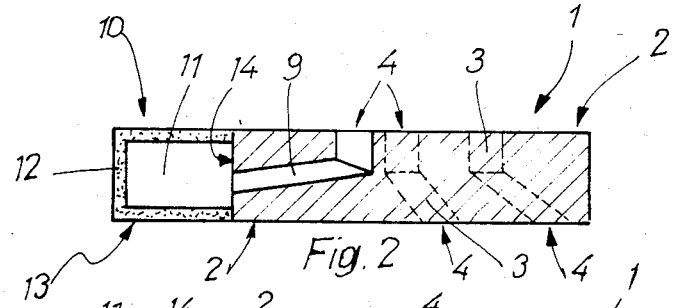
FIG. 2 is a lengthwise section through the connection block taken on the line II—II of FIG. 1.

The chamber 11 of the muffler 10 preferably takes the form of a hollow or pocket in the connection block 1 near the edge, and its outer wall 12 is best made flush and in line with the surface of the connection block 1. The outcome of this is that the connection block 1 will have even outer faces and there is no danger of damage and injury on projecting corners and edges. The muffler 10 may either be molded integrally on the connection block 1 or manufactured as a separate part and then later joined thereto. FIGS. 1 and 2 show one example for the latter alternative. The chamber 11 in this case forms the inner space of a separate housing 13, the wall of which is made of a porous material as for example metal frit. The housiing 13 is air-tightly fixed on the connection block 1. It is made up of a u-section, with legs having a distance between their outer faces equal to the thickness of the connection block 1. The housing 13 is so mounted on the connection block 1 that the space between the legs opens onto the block and the end faces of the legs are placed against a side wall 14 of the connection block 1, the exhaust duct 9 porting in this side. The ends of the u-section are covered over by two lugs 15 forming part of the connection block 1, which run right across the ends of the u-section 13. The outer faces of the u-section and of the connection block 1 are lined up with each other so as to give a regular or smooth outer form. The outer form of the housing 13 is however not an essential feature of the invention; it is only necessary that the housing 13 of the separate muffler 10 be open on one side so that its opening is placed around the port of the exhaust duct 9 in the outer face of the connection block 1. The assembly of the muffler 10 and the connection block 1 to join them together may be effected in a great number of different ways. To take one example, the housing may be bonded or welded in place, or it may be detachably fixed in place by using screws or screws and a flange. In many cases one may do without any special gasket for the housing 13, because a high-level sealing effect is simply unnecessary, the housing itself in fact being porous. However if it should prove desirable, one may have a customary gasket or ring between the muffler housing 13 and the connection block 1.

Figure 3:
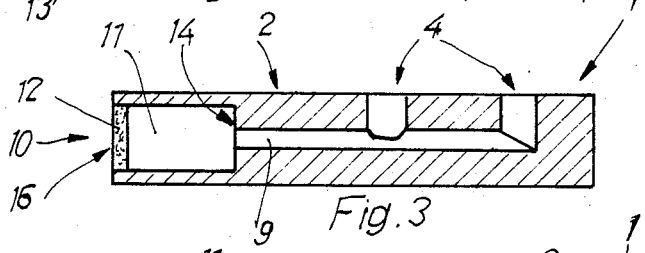
FIGS. 3 and 4 are similar lengthwise sections through two further designs of the connection block in keeping with the present invention.

In keeping with a further possible form of the invention to be seen in FIG. 3, the chamber 11 is in the form of a pocket cut out of the surface of the connection block 1 and it is covered over with a porous plate 16. The outlines of the pocket in the surface and of the plate 16 may be generally arbitrary and are to be selected in keeping with the amount of space available here. FIG. 3 is a view by way of example of an exhaust duct 9 having two ports 4 in the one contact face 2. It is for this reason possible to join up two components 5 giving up exhaust air at two points on the muffler 10, this naturally enough being possible with other designs of the connection block 1 of the invention as well.

Figure 4:
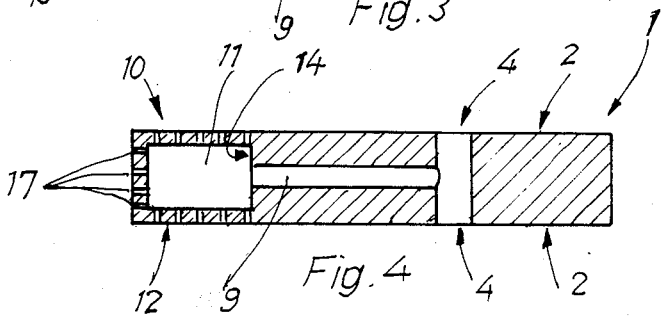

Lastly FIG. 4 shows a design in which the porous walls 12 of the muffler 10 are joined up integrally with the connection block 1. The walls 12 are perforated by a large number of capillary holes 17 that have a choking effect on the low-pressure air coming out through them from the chamber 11 within. The chamber 11 may take the form of a highly irregular pocket within the connection block 1 so that all the possible dead space within the connection block 1 is put to good use. In the working example figured, an exhaust duct 9 ends in the chamber 11, the other end of such duct joining up with two alined ports 4 in opposite sides 2 of the connection block 1. A connection block 1 with such a structure of the chamber and ducts may for example be produced by casting or by forming foam material round a lost core.

A preferred material for manufacture of the connection block 1 in keeping with the present invention is load bearing or structural foam. It is a resin foam material also known as integral foam, that after molding has a foam core or inner part and a solid outer skin or layer. The use of such load bearing foam is a simple way of forming pockets inside the foam block, which may be used as the chamber 11 of the muffler of the invention. In particular, the foam material may be molded around a core that is later removed so that the designer has the greatest freedom with respect to the form of the chamber 11 and the best possible use may be made of dead space in the connection block 1. After foam molding of the integral foam resin, the core is gasified leaving a pocket or space. It is furthermore possible for necessary capillary openings 17 in the outer wall 12 of the chamber 11 to be produced at the same time, this being a useful side effect. For the production of such holes fine wires are embedded in the foam molding resin and taken out of it when it soldifies. It is in this case possible for the connection block 1 to be foam molded in one piece, giving useful effects from the manufacturing angle.

A connection block made of load-bearing foam resin is furthermore specially well suited for use in connection with a separately produced porous housing or covering element of the muffler chamber 11. This element may for example be foam molded with the connection block 1 and produced in the block so that a specially strong, air-tight connection is produced.

The housing or covering element may for this purpose be furnished with anchoring structures, more specially at the junction. It is however possible as well for such a covering element to be bonded onto the finished connection block. To do this the foam-free or solid outer skin is completely or partly pared back or mechanically roughened so as to have a larger surface for the bondant and produce a specially strong and durable bond. The bonding together of the connection block and the muffler at the same time makes certain of a sealed joint therebetween.

I claim:

1. An adapter block for the connection of pneumatic structural elements, comprising a block body having a flat contact surface against which a flat surface of a pneumatic structural element is engageable, said block body having at least one port extending through said flat contact surface and an exhaust duct connected to said port, said block body having at least a portion made of structural foamed plastic defining an expansion chamber, said block body having at least one wall bounding said exhaust chamber, said expansion duct extending through said one wall and having a volume less than a volume of said expansion chamber, and a porous wall connected to said block body and closing said expansion chamber.

2. An adapter block according to claim 1, wherein said porous wall is made of sintered material.

3. An adapter block according to claim 1, wherein said porous wall has at least one portion with an outer surface lying in a common plane with said flat contact surface of said block body.

4. An adapter block according to claim 1, wherein said porous wall is made of structural foamed plastic material and is made as one piece and of the same material as said portion of said block body which defines said expansion chamber and which is also made of structural foamed plastic.

5. An adapter block according to claim 4, wherein said porous wall includes capillary openings which are formed by a core material which is originally positioned in said expansion chamber for defining a shape of said expansion chamber and which is vaporized to form said capillary openings.

6. An adapter block according to claim 4, wherein said entire block body is made of structural foamed plastic, said expansion chamber being defined between side lugs on opposite sides of said expansion chamber, said side lugs having top surfaces which are co-planar with said flat contact surface, said porous wall comprising a U-shaped wall extending around a top, side and bottom of said expansion chamber.

7. An adapter block according to claim 6, wherein said porous wall comprises a sintered metal material sealably connected to said block body.

8. An adapter block according to claim 6, wherein said porous wall is made of the same structural foamed plastic material and is made as one piece with said block body.

* * * * *